US010012411B2

(12) United States Patent
Umakoshi

(10) Patent No.: US 10,012,411 B2
(45) Date of Patent: Jul. 3, 2018

(54) COMBUSTION APPARATUS AND WATER HEATER HAVING SAME

(71) Applicant: Noritz Corporation, Hyogo (JP)

(72) Inventor: Ryosuke Umakoshi, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 144 days.

(21) Appl. No.: 15/067,922

(22) Filed: Mar. 11, 2016

(65) Prior Publication Data

US 2016/0282011 A1 Sep. 29, 2016

(30) Foreign Application Priority Data

Mar. 26, 2015 (JP) ..... 2015-063896

(51) Int. Cl.

| | |
|---|---|
| ***F24H 1/16*** | (2006.01) |
| ***F24H 9/14*** | (2006.01) |
| ***F24H 9/18*** | (2006.01) |
| ***F23L 1/00*** | (2006.01) |
| ***F24H 9/00*** | (2006.01) |
| ***F23D 1/00*** | (2006.01) |
| ***F23D 14/04*** | (2006.01) |
| *F23L 5/02* | (2006.01) |
| *F23C 7/02* | (2006.01) |

(52) U.S. Cl.

CPC ..... *F24H 1/165* (2013.01); *F23D 1/00* (2013.01); *F23D 14/045* (2013.01); *F23L 1/00* (2013.01); *F24H 9/0026* (2013.01); *F24H 9/148* (2013.01); *F24H 9/1836* (2013.01); *F23C 7/02* (2013.01); *F23D 2203/007* (2013.01); *F23D 2214/00* (2013.01); *F23L 5/02* (2013.01)

(58) Field of Classification Search

CPC ..... F24H 2210/00; F24H 9/14; F24H 9/00; F24H 1/14; F24H 14/76; F23D 14/08; F23D 14/78; F28D 2021/0024

See application file for complete search history.

(56) References Cited

U.S. PATENT DOCUMENTS

| | | | | |
|---|---|---|---|---|
| 9,513,003 | B2 * | 12/2016 | Watanabe | F23L 11/02 |
| 2011/0259317 | A1 * | 10/2011 | Kameyama | F24H 1/40 126/344 |
| 2017/0205113 | A1 * | 7/2017 | Oohigashi | F24H 1/14 |

FOREIGN PATENT DOCUMENTS

| | | | |
|---|---|---|---|
| JP | 2005-069640 | A | 3/2005 |
| JP | 2013029256 | A * | 2/2013 |
| JP | 2013-231559 | A | 11/2013 |

* cited by examiner

*Primary Examiner* — Gregory A Wilson
(74) *Attorney, Agent, or Firm* — Studebaker & Brackett PC

(57) ABSTRACT

A combustion apparatus includes a burner and a heat shield plate. The heat shield plate includes a main plate portion located on a lateral side of a flame formation region above the burner to erect, a stepped portion protruding from a lower end of the main plate portion toward the burner and set at approximately the same height as that of a flame hole surface of the burner, and air passage holes provided in the stepped portion. The main plate portion is provided with a facing wall portion which protrudes from a middle part of the main plate portion in a vertical height direction thereof toward the flame formation region and faces the air passage holes so as to be subjected to a collision with air travelling upward from the air passage holes. This configuration allows the heat shield plate to be properly cooled/protected, while reducing consumed air.

11 Claims, 6 Drawing Sheets

COMBUSTION APPARATUS AND WATER HEATER HAVING SAME

BACKGROUND OF THE INVENTION

Field of the Invention

The present invention relates to a combustion apparatus and a water heater having the same.

Description of the Related Art

Specific examples of a combustion apparatus include the ones described in Japanese Patent Applications Laid-open Nos. 2013-231559 and 2005-69640.

In each of the combustion apparatuses described in Japanese Patent Applications Laid-open Nos. 2013-231559 and 2005-69640, heat shield plates are placed inside the side-wall portions of a burner case containing a burner. In each of the heat shield plates, at a position closer to the lower portion thereof, a substantially horizontal stepped portion is formed, and air passage holes are provided in the stepped portion. A part of air sent from a fan attached to a bottom portion of the burner case into the burner case upwardly passes through the air passage holes to flow upward along the inner side surfaces of the heat shield plate. This provides the effect of cooling the heat shield plate and the effect of the air flow inhibiting a flame from the burner and combustion gas from coming into contact with the heat shield plate. As a result, it is possible to inhibit the side-wall portions of the burner case from reaching extraordinarily high temperatures, while preventing heat damage to the heat shield plate.

However, as will be described next, the prior-art technique described above still has room for improvement.

Air sent from the fan into the burner case is intrinsically air for combustion to be used for the combustion drive of the burner. On the other hand, air upwardly passing through the air passage holes of the heat shield plate does not contribute to the combustion in the burner. As a result, when it is attempted to supply a large amount of air into the air passage holes of the heat shield plate, while controlling the amount of air used for the combustion drive of the burner to a proper value, it becomes necessary to increase the amount of air supplied into the burner case by increasing the size of the fan, the number of revolutions of the fan, or the like.

Water heaters include one which uses a heat exchanger of a type referred to as a single-case double-water-tube system in which two types of heat transfer tubes are contained in a side-by-side state in one case. In such a type of water heater, two burners are used to correspond to two types of heat transfer tubes and it is common practice to divide a region above these burners into two regions using a panel divider. It has conventionally been attempted to also cool the panel divider mentioned above using air in the same manner as for the heat shield plate described above. However, in such a case also, the same trouble as described above occurs.

SUMMARY OF THE INVENTION

An object of the present invention has been found in circumstances as described above and lies in providing a combustion apparatus capable of properly cooling and protecting a heat shield plate, while reducing an amount of consumed air used to cool the heat shield plate and a water heater having the same.

To solve the problem described above, the present invention uses the following technical means.

A combustion apparatus provided in accordance with a first aspect of the present invention includes at least one burner having an upward flame hole surface to form flames, a fan which supplies air from under the burner such that air flows upward, and a heat shield plate including a main plate portion located on a lateral side of a flame formation region above the burner to erect in a vertical height direction, a stepped portion protruding from a lower end of the main plate portion toward the burner and set at approximately the same height as that of the flame hole surface, and air passage holes provided in the stepped portion to extend therethrough so as to allow air supplied from the fan and travelling from under the stepped portion to upwardly pass the air passage holes. The main plate portion is provided with a facing wall portion which protrudes from a middle part of the main plate portion in the vertical height direction thereof toward the flame formation region and faces the air passage holes so as to be subjected to a collision with air travelling upward from the air passage holes.

Preferably, the facing wall portion has a substantially horizontal shape.

Preferably, the facing wall portion is configured so as not to be located closer to the flame formation region than the stepped portion in a horizontal direction.

Preferably, the facing wall portion is configured so as not to be located closer to the flame formation region than the air passage holes in the horizontal direction.

Preferably, the combustion apparatus according to the present invention further includes a burner case including a plurality of side-wall portions surrounding a periphery of the burner to contain the burner therein. The heat shield plate is provided so as to cover an inner side surface of at least one of the plurality of side-wall portions.

Preferably, the heat shield plate further includes an upper plate portion extending upward from a front end edge of the facing wall portion to form a part of the main plate portion, and a lower plate portion extending downward from a front end edge of the stepped portion to face and come into contact with or face and come closer to aside surface portion of the burner, and a downwardly opening void portion into which a part of air supplied from the fan flows is formed between the heat shield plate and the side-wall portion of the burner case.

Preferably, the burner includes a plurality of burner main bodies each having a flat overall shape and a flame hole surface extending in a given direction as the flame hole surface. The plurality of burner main bodies are arranged in a direction crossing a longitudinal direction of the flame hole surface, and, as the heat shield plate, a pair of heat shield plates are provided to cover respective inner side surfaces of a pair of side-wall portions which are included in the plurality of side-wall portions and located on both lateral sides of the burner in a direction in which the plurality of burner main bodies are arranged.

Preferably, the combustion apparatus according to the present invention further includes a pair of additional heat shield plates covering respective inner side surfaces of a pair of side-wall portions which are included in the plurality of side-wall portions and located on both lateral sides of the burner in a direction crossing the direction in which the plurality of burner main bodies are arranged. The combustion apparatus is configured such that air supplied from the fan and traveling from underneath flows upward along an inner side surface of each of the additional heat shield plates.

A water heater provided in accordance with a second aspect of the present invention includes the combustion apparatus, and a heat exchanger provided above the burner to heat water using the burner to provide hot water.

Preferably, in the combustion apparatus according to the present invention, a plurality of burners are provided as the burner, and the heat shield plate is provided so as to partition the flame formation region formed above the plurality of burners into a plurality of regions.

Preferably, the combustion apparatus according to the present invention further includes, as a member defining the plurality of regions, a partition body formed separately from the heat shield plate. The heat shield plate is provided so as to cover at least a part of the partition body.

A water heater provided in accordance with a third aspect of the present invention includes the combustion apparatus, and a plurality of heat exchangers provided individually above the plurality of regions to heat water using the plurality of burners to provide hot water.

Preferably, in the combustion apparatus according to the present invention, a plurality of burners are provided as the burner. The combustion apparatus further includes a burner case including a plurality of side-wall portions surrounding a periphery of the plurality of burners to contain the plurality of burners therein. As the heat shield plate, first and second heat shield plates are provided. The first heat shield plate covers an inner side surface of at least one of the plurality of side-wall portions. The second heat shield plate partitions the flame formation region formed above the plurality of burners into a plurality of regions.

Further features and advantages of the present invention will become apparent from the following description of embodiments of the present invention made with reference to the attached drawings.

DETAILED DESCRIPTION OF THE PREFERRED EMBODIMENTS

The following will specifically describe preferred embodiments of the present invention with reference to the drawings.

Figure 1:
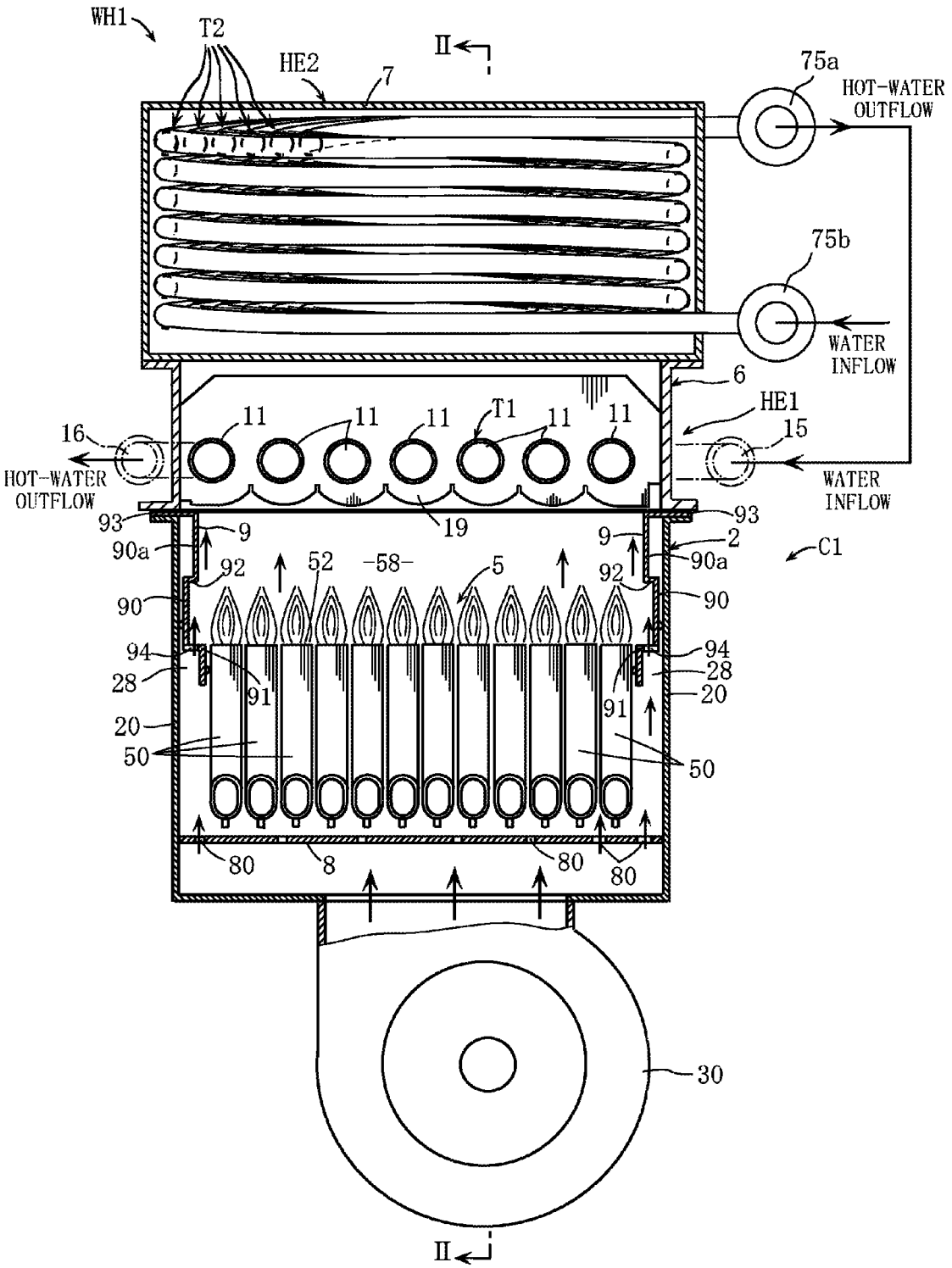
FIG. 1 is a front cross-sectional view showing an example of a water heater including a combustion apparatus according to the present invention.
Figure 2:
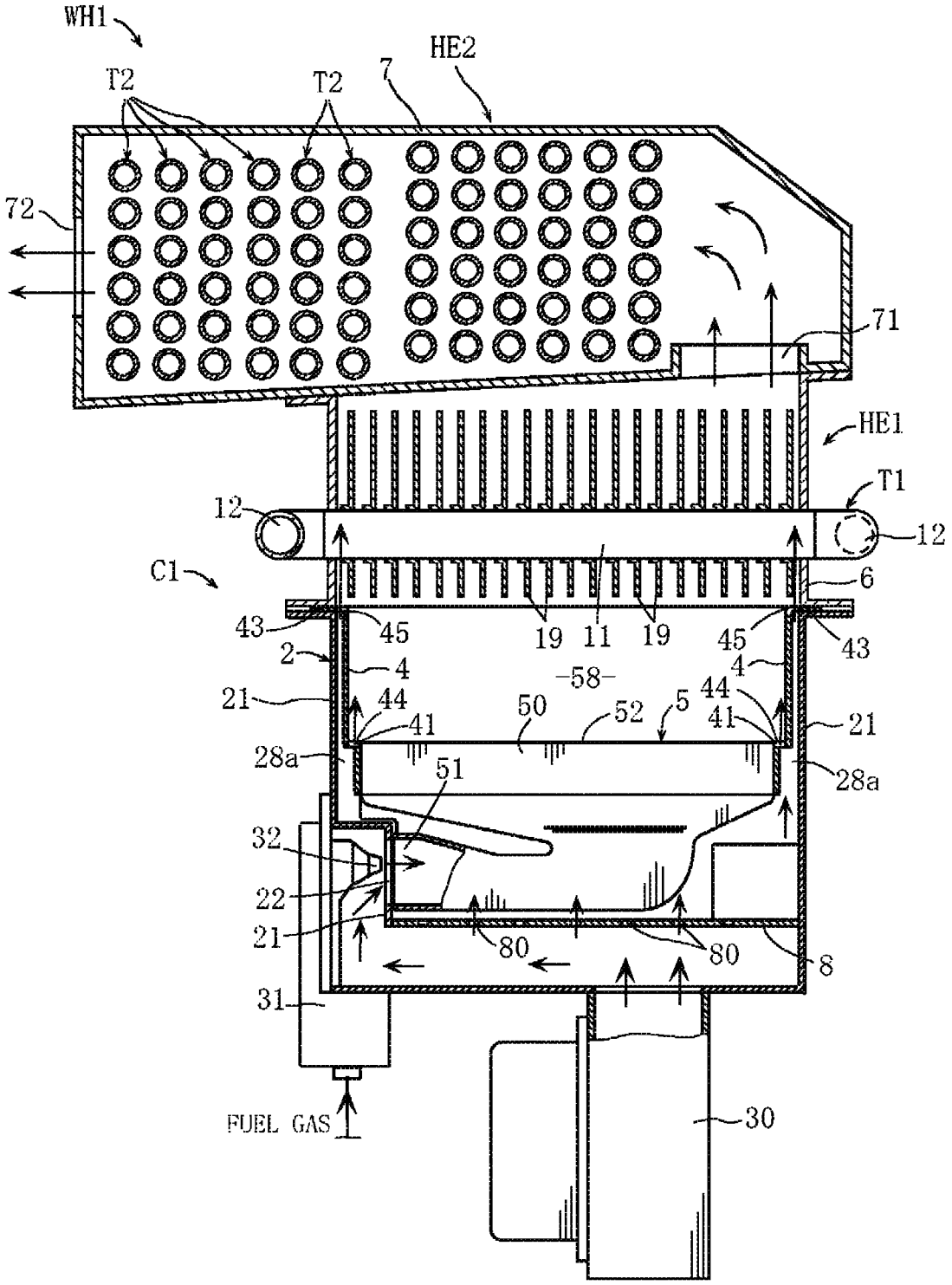
FIG. 2 is a cross-sectional view along the line II-II in FIG. 1.

A water heater WH1 shown in FIGS. 1 and 2 includes a combustion apparatus C1 and primary and secondary heat exchangers HE1 and HE2. As shown in FIG. 1, the combustion apparatus C1 includes a burner 5 which generates combustion gas, a burner case 2 containing the burner 5, and a fan 30 for supplying air for combustion provided in the burner case 2. In addition, as shown in FIG. 2, the combustion apparatus C1 also includes a pair of additional heat shield plates 4.

The primary and secondary heat exchangers HE1 and HE2 have basic configurations which are the same as those described in Japanese Patent Application Laid-open No. 2013-231559. To put it briefly, the primary heat exchanger HE1 includes a case 6 having a substantially rectangular frame shape and mounted on the burner case 2, a heat transfer tube T1 contained in the case 6, and a plurality of fins 19. The heat transfer tube T1 has a configuration in which a plurality of linear tubular body portions 11 are connected in a series via curved tubular body portions 12 such as U-shaped tubes. The plurality of fins 19 are in the form of a plate through which the linear tubular body portions 11 of the heat transfer tube T1 extend to be joined thereto. The secondary heat exchanger HE2 includes a case 7 mounted on the primary heat exchanger HE1 and a plurality of helical heat transfer tubes T2 contained in the case 7. The combustion gas that has passed through the primary heat exchanger HE1 flows from an inlet port 71 in the bottom portion of the case 7 into the case 7 and travels toward an outlet port 72 in the front part of the case 7. Water to be heated is supplied to a water inflow header 75*b* of the secondary heat exchanger HE2 and passes through the plurality of heat transfer tubes T2 to be heated. The heated water subsequently reaches a hot-water outflow header 75*a* and is then sent from a water inflow hole 15 of the primary heat exchanger HE1 into the heat transfer tube T1 to be further heated. Then, hot water flows out of a hot-water outflow hole 16.

The burner 5 is, e.g., a gas burner and has a configuration in which a plurality of burner main bodies 50 (combustion tubes) are provided in a side-by-side state. As each of the burner main bodies 50, e.g., the conventionally known one described in Japanese Patent Application Laid-open No. 2013-242080 can be used. To put it briefly, each of the burner main bodies 50 has a flat overall shape. As shown in FIG. 2, in the lower portion of one end of the burner main body 50 in the longitudinal direction thereof, a fuel gas inlet 51 is provided while, in the upper portion thereof, a flame hole surface 52 having an elongated rectangular shape in plan view extending in the longitudinal direction of the burner main body 50 is formed. In the front wall portion of the burner case 2, an opening 22 facing the fuel gas inlet 51 is provided and, to the opening 22, a part of air supplied from the fan 30 is supplied. On the other hand, on the front side of the burner case 2, a header 31 for supplying a fuel gas is provided and a fuel gas can be blown out of a nozzle 32 of the header 31 into the opening 22. Into the burner main bodies 50, the mixture of the fuel gas and air for combustion (primary air) is supplied from the opening 22 and the fuel gas inlet 51 and burnt in the flame hole surface 52. Under the burner 5, a current plate 8 having a plurality of vent holes 80 is provided. A part of air (secondary air) supplied from the fan 30 into the burner case 2 passes through the vent holes 80 to be supplied to the region where the burner 5 is placed.

Figure 4:
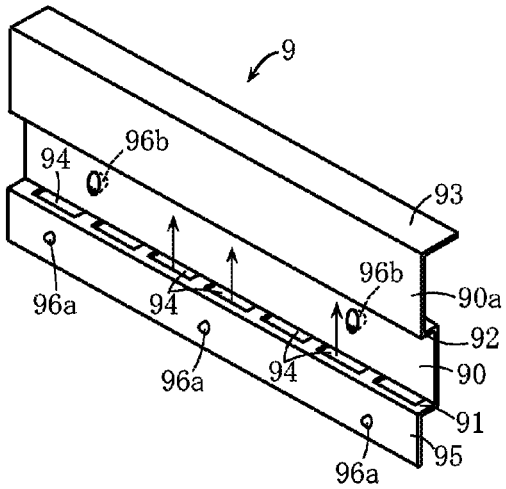
FIG. 4 is a perspective view of the heat shield plate used in the combustion apparatus shown in FIG. 1.

In FIG. 1, a pair of heat shield plates 9 are for inhibiting a pair of left and right side-wall portions 20 of the burner case 2 from being heated and providing protection. Each of the heat shield plates 9 is formed by subjecting a metal plate to bending or the like and has a form as shown in FIG. 4. Specifically, the heat shield plate 9 has a substantially rectangular shape in front view basically extending in a vertical height direction. However, the heat shield plate 9 is bent at a plurality of portions in the height direction thereof and has a stepped portion 91, a facing wall portion 92, and an upper-end bent portion 93. Of the heat shield plate 9, the region located above the stepped portion 91 serves as a main plate portion 90. The stepped portion 91 protrudes forward from the lower end of the main plate portion 90 into a substantially horizontal shape. In the stepped portion 91, a plurality of air passage holes 94 are provided to be arranged at predetermined intervals. To the front end edge of the stepped portion 91, a lower plate portion 95 extending downward from the front end edge is connected.

Figure 3:
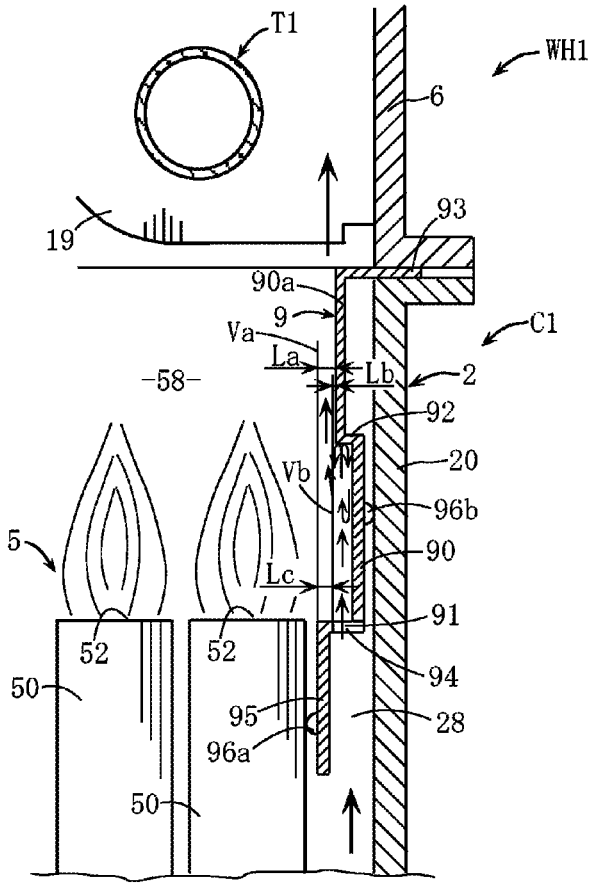
FIG. 3 is an enlarged main-portion cross-sectional view of FIG. 1.

Each of the heat shield plates 9 is set in a state as shown in FIG. 3. In FIG. 3, the lower plate portion 95 has small-sized projecting portions 96*a* and the projecting portions 96*a* are located on a lateral side of the burner 5 so as to abut on the side surface portion of the burner 5. The main plate portion 90 has small-sized protruding portions 96*b*. The protruding portions 96*b* are located on a lateral side of a flame formation region 58 above the burner 5 so as to abut on the side-wall portion 20 of the burner case 2. The upper-end bent portion 93 is interposed between the burner case 2 and the case 6 and fixed. In the upper-end bent portion 93, no opening for air passage is provided. The stepped portion 91 has approximately the same height as those of the flame hole surfaces 52 of the burner 5. Here, the "approximately the same height" corresponds to a range from a height of a level at which the stepped portion 91 is not exposed to the flames formed at the flame hole surfaces 52 to a height of a level at which the flames do not become unstable due to the cooling air that has passed through the air passage holes 94 described later.

Of air supplied from the fan 30 into the burner case 2, a part is intended to flow into a void portion 28 between the lower plate portion 95 and the side-wall portion 20 of the burner case 2 and then upwardly pass through each of the air passage holes 94 as air for cooling the heat shield plate 9. Preferably, each of the air passage holes 94 is retracted from the front end edge of the stepped portion 91 toward the main plate portion 90 (to the right side in FIG. 3) by a proper dimension Lc. When the air passage holes 94 are brought excessively close to the flames from the burner 5, the flames from (combustion in) the burner 5 may become unstable under the influence of air passing through the air passage holes 94. However, the configuration described above can eliminate the possibility of such unstable flames.

The facing wall portion 92 is a portion to be subjected to a collision with air that has upwardly passed through the plurality of air passage holes 94 and protrudes forward substantially horizontally from the middle portion of the main plate portion 90 in the height direction thereof. The main plate portion 90 has an upper plate portion 90*a* erecting upward from the front end edge of the facing wall portion 92. The facing wall portion 92 and the upper plate portion 90*a* are provided so as not to be located closer to the flame formation region 58 than the stepped portion 91 in a horizontal direction. In other words, in FIG. 3, the front end of the facing wall portion 92 and the surface of the upper plate portion 90*a* are located rightward of a vertical line Va passing through the front end of the stepped portion 91 by a dimension La or located on the vertical line Va. Preferably, the facing wall portion 92 and the upper plate portion 90*a* are provided so as not to be located closer to the flame formation region 58 than each of the air passage holes 94 in the horizontal direction. In other words, the front end of the facing wall portion 92 and the surface of the upper plate portion 90*a* are located rightward of a vertical line Vb passing through the front edge portion of the air passage holes 94 by a dimension Lb or located on the vertical line Vb.

The additional heat shield plates 4 shown in FIG. 2 has the same configuration as that described in Japanese Patent Application Laid-open No. 2013-231559. Accordingly, the additional heat shield plates 4 allow air that has passed through the void portion 28*a* to upwardly pass therethrough from the air passage holes 44 and 45 provided in the stepped portion 41 and the upper-end bent portion 43, though a detailed description thereof is omitted. The additional heat shield plates 4 are provided so as to protect a pair of side-wall portions 21 of the burner case 2. When these side-wall portions 21 are compared to the side-wall portions 20 described above, the distances from the flame hole surfaces 52 of the burner 5 to the side-wall portions 21 are larger than the distances from the flame hole surfaces 52 to the side-wall portions 20 and the degree to which the side-wall portions 21 are heated with the burner 5 is lower than the degree to which the side-wall portions 20 are heated with the burner 5. In addition, air that has upwardly passed through the air passage holes 45 serves to cool the case 6. Therefore, in the present embodiment, as a means for protecting the side-wall portions 21, the additional heat shield plates 4 having a configuration different from that of the heat shield plates 9 are used. However, unlike in the present embodiment, it is also possible to provide a configuration in which the heat shield plates 9 are provided also inside the side-wall portions 21.

Next, a description will be given of the effect of the water heater WH1 including the combustion apparatus C1.

When the combustion apparatus C1 is operated, as shown in FIG. 3, air for cooling upwardly passes through each of the air passage holes 94 of the heat shield plate 9. As a result, the air collides with the lower surface portion of the facing wall portion 92 to be returned downwardly so that a region located under and in the vicinity of the facing wall portion 92 becomes a region where the eddying current of air or an air flow close thereto is generated. To the region, air that has passed through the air passage holes 94 is sequentially supplied. This prevents air heated to a high temperature from staying in the region and, while replacement with newly supplied air at a relatively low temperature is sequentially performed, the eddying current or the air flow close thereto mentioned above is continuously generated. When such an air flow is generated under the facing wall portion 92, apart of air that has traveled from the air passage holes 94 toward the facing wall portion 92 passes through a region closer to the flame formation region 58 than the region with the air flow to thicken the layer of the cooling air formed along the surface layer portion of the heat shield plate 9. This also provides the effect of allowing a part of air to smoothly go over the facing wall portion 92 and properly flow along the surface of the upper plate portion 90*a*. Since an opening such as an air passage hole is not provided in the upper-end bent portion 93, a substantially full amount of air that has entered the void portion 28 passes through the air passage holes 94 in the stepped portion 91.

On the basis of effects as described above, in the present embodiment, it is possible to increase the efficiency with which the heat shield plates 9 are cooled, while reducing the amount of air passing through the air passage holes 94 to a relatively small value. It is also possible to obtain the excellent effect of preventing the flames from the burner 5 and the combustion gas from coming into direct contact with the heat shield plates 9. Accordingly, not only heat damage to the heat shield plates 9 is prevented, but also the side-wall portions 20 of the burner case 2 are properly prevented from reaching an extraordinarily high temperature. The amount of the blast from the fan 30 need not significantly be increased and the number of revolutions of the fan 30 can rather be reduced. Therefore, it is also possible to provide the advantage of reducing the running cost of the combustion apparatus C1.

As has already been described, the facing wall portion 92 and the upper plate portion 90*a* of each of the heat shield plates 9 are provided so as not to be located closer to the flame formation region 58 than the stepped portion 91. Accordingly, heat damage is less likely to be given thereto. Preferably, the facing wall portion 92 and the upper plate portion 90*a* are provided so as not to be located closer to the flame formation region 58 than the front edge portions of the air passage holes 94. As a result, it is possible to prevent these portions from coming closer than necessary to the flame formation region 58 and also allow air that has passed through the air passage holes 94 to efficiently and properly collide with the facing wall portion 92.

Figure 5A:
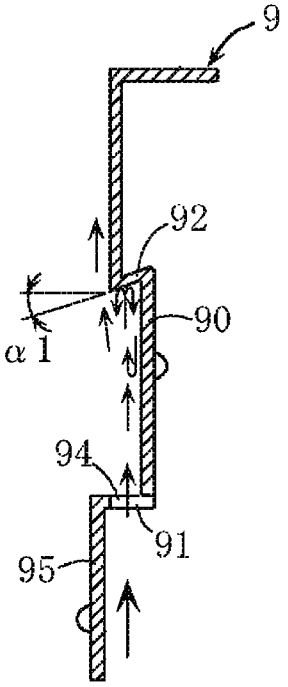
FIGS. 5A to 5C are cross-sectional views showing another example of the heat shield plate.
Figure 5B:
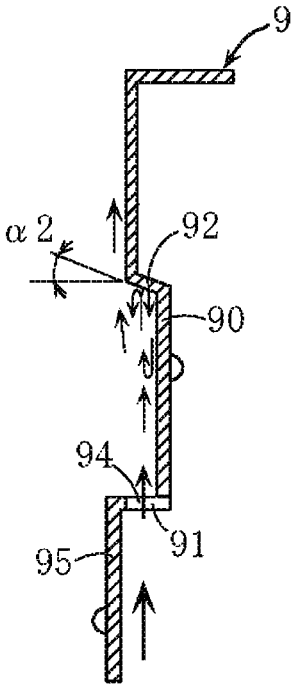
Figure 5C:
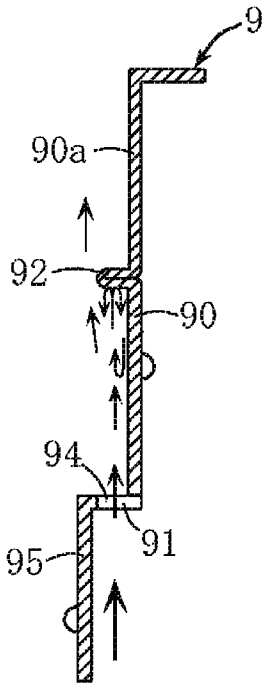
Figure 6:
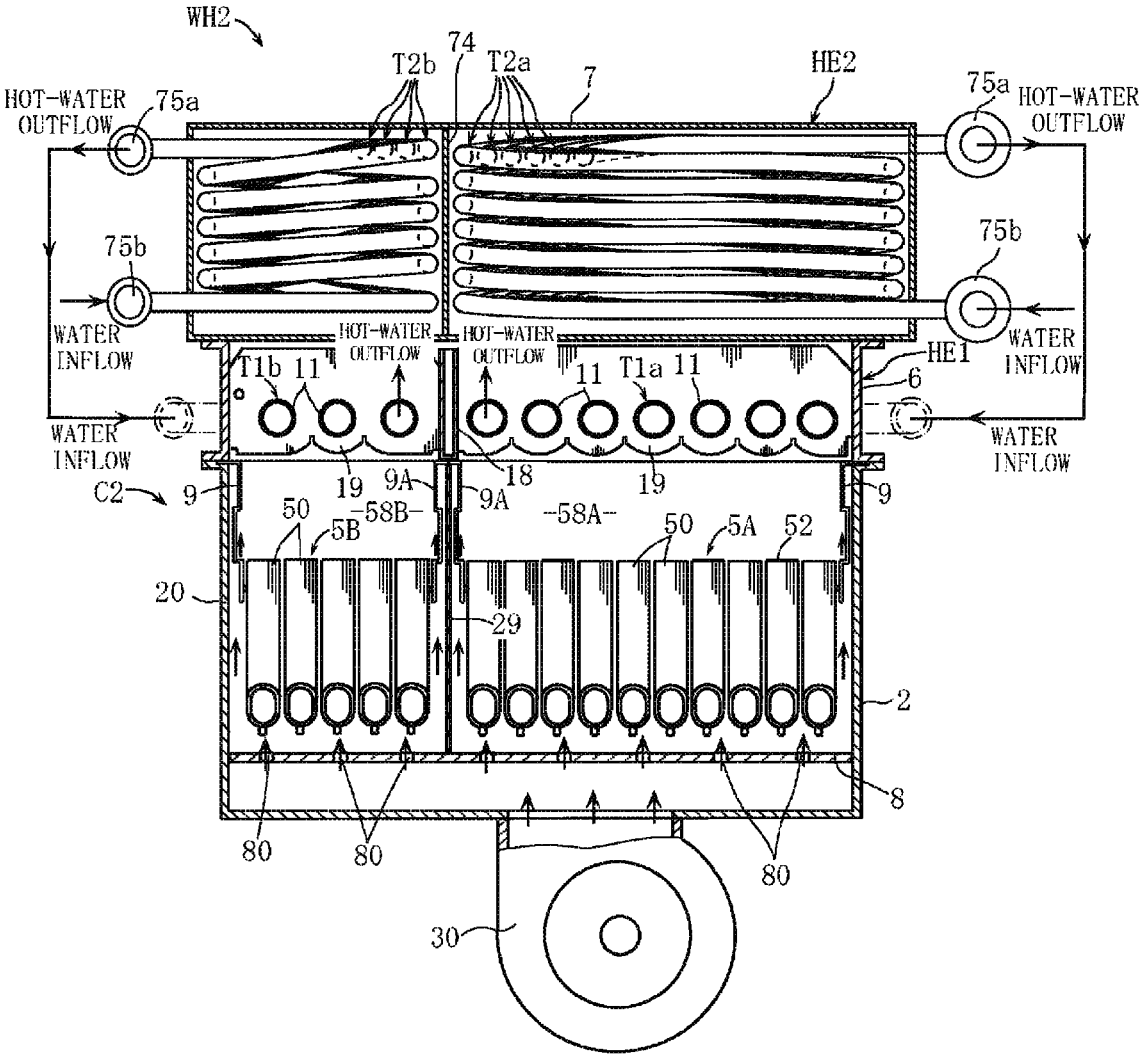
FIG. 6 is a front cross-sectional view showing another example of the present invention.
Figure 7:
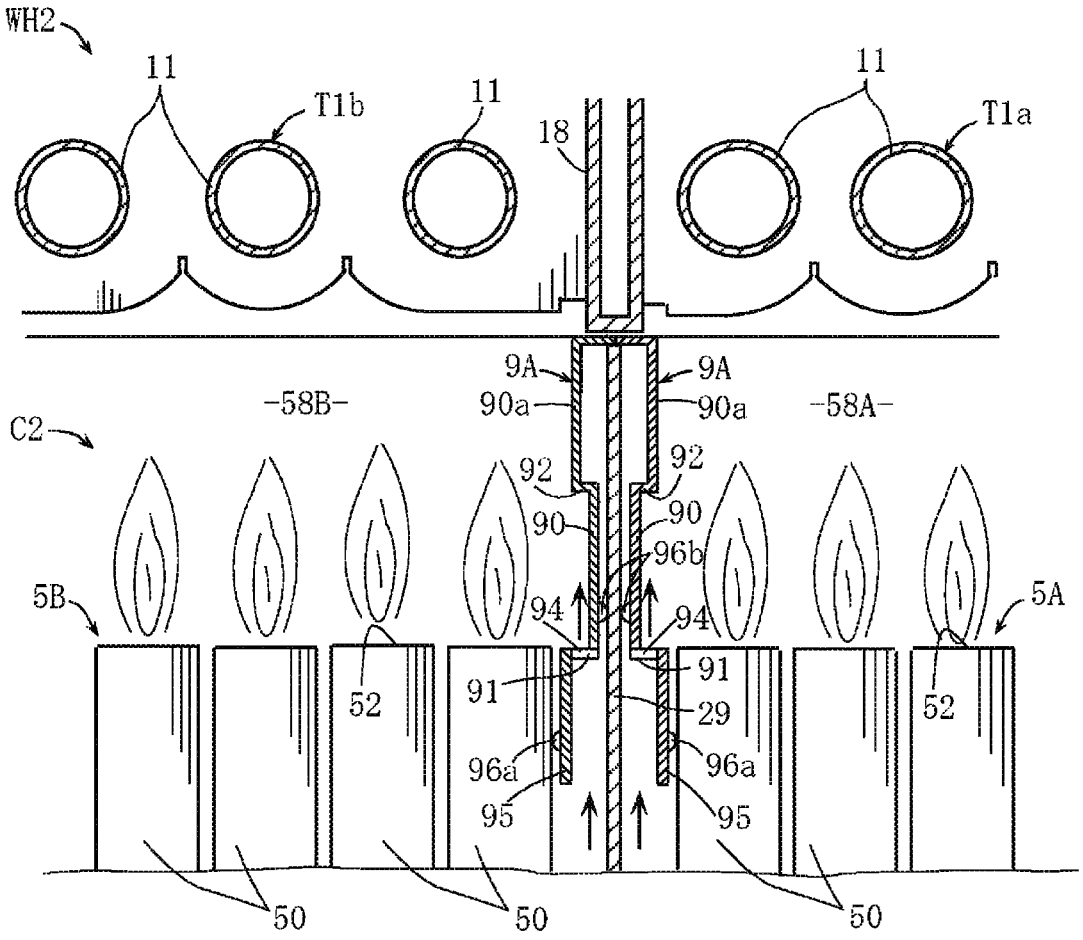
FIG. 7 is an enlarged main-portion cross-sectional view of FIG. 6.

FIGS. 5 to 7 show another embodiment of the present invention. In these drawings, elements which are the same as or similar to those in the embodiment are designated by the same reference numerals as in the embodiment and a repeated description thereof is omitted.

In the configuration shown in FIG. 5A, the facing wall portion 92 of the heat shield plate 9 has a forwardly downward shape which is inclined at a proper angle $\alpha 1$ relative to a horizontal line. In the configuration shown in FIG. 5B, the facing wall portion 92 has a forwardly upward shape which is inclined at a proper angle $\alpha 2$ relative to the horizontal line. Preferably, the angle $\alpha 2$ is set to 45° or less.

In either of these configurations, when air that has passed through the air passage holes 94 collides with the facing wall portion 92, it is possible to generate the eddying current of air or a flow close thereto under or obliquely under the facing wall portion 92 and obtain the effect intended by the present invention. However, as in the embodiment shown in FIGS. 1 to 4, the facing wall portion 92 preferably has a substantially horizontal shape.

In the configuration shown in FIG. 5C, the upper plate portion 90*a* extends upward from the proximal end portion of the facing wall portion 92. In the present invention, such a configuration can also be provided.

In a water heater WH2 shown in FIG. 6, each of the primary and secondary heat exchangers HE1 and HE2 uses a so-called single-case double-water-tube system. A combustion apparatus C2 includes first and second burners 5A and 5B. The water heater WH2 is capable of independently performing general water heater and bath water heater (or air heating water heater) and has a basic configuration common to that described in Japanese Patent Application Laid-open No. 2013-231559. The following is a brief description of the water heater WH2. In the primary heat exchanger HE1, two types of heat transfer tubes T1*a* and T1*b* to and from which water input and hot-water output are individually performed are provided in a side-by-side state in the case 6 and separated from each other via a partitioning member 18. In the secondary heat exchanger HE2, two types of heat transfer tubes T2*a* and T2*b* to and from which water input and hot-water output are individually performed are provided in a side-by-side state in the case 7 and separated from each other via a partitioning member 74. From the combustion gas generated by the first burner 5A, heat recovery using the heat transfer tubes T1*a* and T2*a* is performed to heat water to provide hot water for general water heater. From the combustion gas generated by the second burner 5B, heat recovery using the heat transfer tubes T1*b* and T2*b* is performed to heat water to provide hot water for bath water heater or air heating water heater.

In the burner case 2, not only the pair of heat shield plates 9 (first heat shield plate) having the same configuration as shown in the previous embodiment, but also a partition body 29 and a pair of heat shield plates 9A (second heat shield plate) are provided. As clearly shown in FIG. 7, the partition body 29 has, e.g., a flat plate shape erecting in a vertical direction to separate the first and second burners 5A and 5B from each other and separate flame formation regions 58A and 58B located above the burners 5A and 5B from each other. Each of the heat shield plates 9A, which protects the partition body 29 and also functions as a partitioning member, has the same configuration as that of each of the previously described heat shield plates 9. Specifically, the heat shield plate 9A has the main plate portion 90 including the upper plate portion 90*a*, a stepped portion 91 having the plurality of air passage holes 94, the facing wall portion 92, and the lower plate portion 95. The pair of heat shield plates 9A are provided on both sides of the partition body 29 so as to cover the left and right both surfaces thereof.

The partition body 29 and the heat shield plates 9A are provided between the first and second burners 5A and 5B and therefore are likely to be heated to a rather high temperature. However, in the present embodiment, of air supplied from the fan 30 into the burner case 2, air that has upwardly passed through the air passage holes 94 of the heat shield plates 9A collides with the facing wall portions 92 to generate eddying currents or air flows close thereto under the facing wall portions 92. As a result, it is possible to perform efficient cooling and protection of the heat shield plates 9A on the basis of the same effect as described with respect to the heat shield plates 9 in the previous embodiment and thus appropriately prevent heat damage to the partition body 29.

In the present invention, unlike in the embodiment, it is also possible to provide a configuration in which the flame formation regions 58A and 58B are separated only by the heat shield plates 9A without using the partition body 29.

The present invention is not limited to the contents of the embodiments described above. The specific configurations of the individual parts of the combustion apparatus and the water heater according to the present invention can be subjected to various design changes within the scope intended by the present invention.

The heat shield plates can be used in applications for preventing the side-wall portions of the burner case and the partitioning member between the burners from reaching high temperatures. However, the heat shield plates can also be used for the purpose of preventing the other members or portions from reaching high temperatures. Accordingly, the specific locations, number, sizes, and the like of the heat shield plates are not limited. Each of the heat shield plates can be produced by subjecting a metal plate to press working or the like. However, the material and production process thereof are not limited. It is also possible to use a means which provides a heat-resistant coating layer on the surface of each of the heat shield plates. The heat shield plate need not necessarily be formed using a single member and can also be configured by, e.g., connecting a plurality of members.

The combustion apparatus according to the present invention is not limited to the use thereof in the water heater and can also be configured as a combustion apparatus for air heating. The burners are not limited to gas burners. For example, oil burners can also be used. Instead of the burner in which the plurality of flat burner main bodies are arranged, a burner formed in a plate-like overall shape can also be used as the burner.

The invention claimed is:

1. A combustion apparatus, comprising:

a burner having an upward flame hole surface to form flames;

a fan which supplies air from under the burner such that air flows upward; and a heat shield plate including a main plate portion located on a lateral side of a flame formation region above the burner to erect in a vertical height direction, a stepped portion protruding from a lower end of the main plate portion toward the burner and set at approximately the same height as that of the flame hole surface, and air passage holes provided in the stepped portion to extend therethrough so as to allow air supplied from the fan and travelling from under the stepped portion to upwardly pass the air passage holes, wherein the main plate portion is provided with a facing wall portion which protrudes from a middle part of the main plate portion in the vertical height direction thereof toward the flame formation region and faces the air passage holes so as to be subjected to a collision with air travelling upward from the air passage holes, the facing wall portion includes a downward surface, the downward surface faces the air passage holes and collides with air travelling upward from the air passage holes, the facing wall portion is provided so as to be located further from the flame formation region than the stepped portion in a horizontal direction.

2. The combustion apparatus according to claim 1, wherein the facing wall portion is provided so as to be located further from the flame formation region than the air passage holes in the horizontal direction.

3. The combustion apparatus according to claim 1, further comprising:

a burner case including a plurality of side-wall portions surrounding a periphery of the burner to contain the burner therein, wherein the heat shield plate is provided so as to cover an inner side surface of at least one of the plurality of side-wall portions.

4. The combustion apparatus according to claim 3, wherein the heat shield plate further includes:

an upper plate portion extending upward from a front end edge of the facing wall portion to form a part of the main plate portion; and a lower plate portion extending downward from a front end edge of the stepped portion to face and come into contact with or face and come closer to a side surface portion of the burner, and a downwardly opening void portion into which a part of air supplied from the fan flows is formed between the heat shield plate and the side-wall portion of the burner case.

5. The combustion apparatus according to claim 3, wherein the burner includes a plurality of burner main bodies each having a flat overall shape and a flame hole surface extending in a given direction as the flame hole surface, the plurality of burner main bodies being arranged in a direction crossing a longitudinal direction of the flame hole surface, and as the heat shield plate, a pair of heat shield plates are provided to cover respective inner side surfaces of a pair of side-wall portions which are included in the plurality of side-wall portions and located on both lateral sides of the burner in a direction in which the plurality of burner main bodies are arranged.

6. The combustion apparatus according to claim 5, further comprising:

a pair of additional heat shield plates covering respective inner side surfaces of a pair of side-wall portions which are included in the plurality of side-wall portions and located on both lateral sides of the burner in a direction crossing the direction in which the plurality of burner main bodies are arranged, the combustion apparatus being configured such that air supplied from the fan and traveling from underneath flows upward along an inner side surface of each of the additional heat shield plates.

7. A water heater, comprising:

the combustion apparatus according to claim 5; and a heat exchanger provided above the burner to heat water using the burner to provide hot water.

8. The combustion apparatus according to claim 1, wherein a plurality of burners are provided as the burner, and the heat shield plate is provided so as to partition the flame formation region formed above the plurality of burners into a plurality of regions.

9. The combustion apparatus according to claim 8, further comprising, as a member defining the plurality of regions, a partition body formed separately from the heat shield plate, wherein the heat shield plate is provided so as to cover at least a part of the partition body.

10. A water heater, comprising:

the combustion apparatus according to claim 9; and a plurality of heat exchangers provided individually above the plurality of regions to heat water using the plurality of burners to provide hot water.

11. The combustion apparatus according to claim 1, wherein a plurality of burners are provided as the burner, the combustion apparatus further comprising:

a burner case including a plurality of side-wall portions surrounding a periphery of the plurality of burners to contain the plurality of burners therein, wherein as the heat shield plate, first and second heat shield plates are provided, the first heat shield plate covering an inner side surface of at least one of the plurality of side-wall portions, and the second heat shield plate partitioning the flame formation region formed above the plurality of burners into a plurality of regions.

* * * * *